US008794604B2

(12) United States Patent
Ryu

(10) Patent No.: US 8,794,604 B2
(45) Date of Patent: Aug. 5, 2014

(54) METHOD AND APPARATUS FOR GENERATING NANO-BUBBLES IN LIQUID

(75) Inventor: Sang-Ryul Ryu, Jeongeup (KR)

(73) Assignee: GK Oxy Co., Ltd., Jeollabuk-Do (KR)

( * ) Notice: Subject to any disclaimer, the term of this patent is extended or adjusted under 35 U.S.C. 154(b) by 788 days.

(21) Appl. No.: 13/023,964

(22) Filed: Feb. 9, 2011

(65) Prior Publication Data

US 2012/0086137 A1 Apr. 12, 2012

(30) Foreign Application Priority Data

Oct. 6, 2010 (KR) ..... 10-2010-0097260

(51) Int. Cl.
*B01F 3/04* (2006.01)

(52) U.S. Cl.
CPC ... *B01F 3/04262* (2013.01); *B01F 2003/04276* (2013.01); *B01F 2003/04319* (2013.01); *B01F 2003/04858* (2013.01)
USPC ..... 261/122.1

(58) Field of Classification Search
CPC ..... B01F 3/04262; B01F 2003/04276; B01F 2003/04312; B01F 2003/04319; B01F 2003/0439; B01F 2003/04858
USPC ..... 261/122.1; 210/220
See application file for complete search history.

(56) References Cited

U.S. PATENT DOCUMENTS 1,208,821 A * 12/1916 Nordell ..... 261/121.1
1,281,816 A * 10/1918 Nordell ..... 261/122.1
2,216,791 A * 10/1940 Simjian ..... 261/42
3,524,430 A * 8/1970 Willinger ..... 119/263
7,472,895 B2 * 1/2009 Watt ..... 261/122.1

FOREIGN PATENT DOCUMENTS

| | | |
|---|---|---|
| JP | 08-225094 | 9/1996 |
| KR | 0155482 | 7/1998 |
| KR | 100844141 | 6/2008 |
| KR | 100845785 | 7/2008 |

OTHER PUBLICATIONS

Takahashi et al., "Free-Radical Generation from Collapsing Microbubbles in the Absence of a Dynamic Stimulus", J. Phys. Chem. B2007, vol. 111, pp. 1343-1347, 2007.
Takahashi et al., "Effect of Shrinking Microbubble on Gas Hydrate Formation", The Jounal of Physical Chemistry, vol. 107, No. 10, pp. 2171-2173, 2003.

(Continued)

*Primary Examiner* — Charles Bushey
(74) *Attorney, Agent, or Firm* — IPLA P.A.; James E. Bame

(57) ABSTRACT

A method for generating and dissolving nano-bubbles in a liquid comprises the steps of preparing a bamboo filter by partially or entirely removing an enamel layer of a bamboo and using a bamboo fibrous layer therein as a component of a filter; applying a gas to an inside of the bamboo filter with a pressure over atmospheric pressure in a state where the bamboo filter is submerged in water; and making the gas permeate from an inside of the bamboo fibrous layer to an outside thereof, thereby forming nano-bubbles and at the same time dissolving the gas in the liquid. The present invention advantageously allows the generation of nano-sized fine bubbles by a filter member made of naturally occurring material so that the nano-bubbles are dissolved in a liquid, without applying external mechanical force to the water.

3 Claims, 5 Drawing Sheets

(56) References Cited

OTHER PUBLICATIONS

Liu et al., "Effect of micro-bubbles on coagulation flotation process of dyeing wastewater", Separation and Purification Technology, vol. 71, pp. 337-346, 2010.

Ushikuboa et al., "Evidence of the Existence and the Stability of Nano-bubbles in Water", Colloids and Surfaces A: Physicochem. Eng. Aspects, Mar. 10, 2010.

Katiyar et al., "Stability analysis of an encapsulated microbubble against gas diffusion", Journal of Colloid and Interface Science, vol. 343, pp. 42-47, 2010.

* cited by examiner

METHOD AND APPARATUS FOR GENERATING NANO-BUBBLES IN LIQUID

CROSS REFERENCE

This application claims foreign priority under Paris Convention and 35 U.S.C. §119 to Korean Patent Application No. 10-2010-0097260, filed Oct. 10, 2010 with the Korean Intellectual Property Office.

BACKGROUND OF THE INVENTION

1. Field of the Invention

The present invention relates to a method and apparatus for generating nano-bubbles in a liquid, and more particularly, to a method for generating nano-sized fine bubbles by using a bubble generating member made of naturally occurring materials without applying an external mechanical force to a liquid, and a nano-bubble generating apparatus suitable for implementing the method.

2. Description of the Related Art

Generally, gases newly generated in a liquid or permeated into the liquid create fine bubbles, are dissolved and absorbed in the liquid, or remain as bubbles in the liquid. The bubbles remaining in the liquid tend to have a smaller specific gravity in comparison with the liquid, so that the bubbles move upward and float. However, if the bubbles have a size smaller than a certain level, it is known that the bubbles do not float to the liquid surface but remain in the liquid as they are or shrink in the liquid by external pressure and are finally ruptured, so that the gases in the bubbles are dissolved in the liquid.

As mentioned above, in a case where specific fine bubbles are generated in a certain liquid, on the one hand, such a liquid dissolves specific gas, and on the other hand the liquid is present with the fine bubbles of the gas contained therein. At this time, in a case where the specific gas is selected to be useful for an organism and the certain liquid is also selected to be useful for or harmless to the organism, such a liquid material in this state may give a very useful effect to the organism. In addition, when the specific gas is selected to be useful for the industry, such a liquid material may be used as a very useful material for the industry. Thus, in the present invention, the liquid is preferably water harmless to the human body, or the liquid may be an aqueous solution obtained by applying a small amount of additive to the water, or other liquids.

Generally, in properties of bubbles dissolved in water, bubbles having a size greater than 50 μm float on the surface of water within several seconds and are diffused in the air, while bubbles having a size of 50 μm to some hundreds of nanometers may remain in the water up to 6 months. It is known that these bubbles gradually shrink and rupture in the water so that the corresponding gas is dissolved in the water over a saturated concentration.

When a large amount of bubbles with a fine size are generated at a time, the concentration of a gas dissolved in the water may be increased. When the bubbles remain in the water for a long time, the water may be advantageously utilized as a drinking water in which a gas such as oxygen or hydrogen is dissolved in a high concentration.

Conventional or applicable techniques for making a drinking water by generating nano-bubbles in water to increase the solubility of gas (oxygen) are known as follows.

A dissolved gas method is a method in which a closed container filled with water or beverage is charged with a gas at a high pressure, so that the gas is dissolved in the water or beverage. If this method is used, the gas dissolved in the water or beverage is released out as it bounds off the moment the closed container is opened. Using this property of gas, this method is utilized for charging a soft drink with carbonic acid gas. However, if this method is used, the gas dissolved in the water or beverage comes out of the container and is discharged out the moment the closed container is opened, and thus, the gas cannot be disadvantageously maintained in a state where it is dissolved in the water or beverage for a long time.

A hydrodynamic method is a mechanical mixing method, in which water and oxygen are ejected at the same time toward a motor propeller that rotates at a high speed of about 10,000 to 20,000 rpm so that oxygen gases are forcibly adsorbed to the surface of water particles. In general, a container is filled with a liquid such as water, and then, while applying a gas thereto from the outside, the gas and the liquid are mixed using a high-speed rotational force. However, in this method, the liquid material is rotated by using a high-speed rotational force, so that a fine physical-chemical structure of the liquid material is disadvantageously broken. In particular, in case of a drinking water, the water may suffer from stress during a manufacturing process. In addition, there is a disadvantage in that in this method a large amount of energy should be supplied in order to obtain a high-speed rotational force, and there is a limit in a dispersing force of the gas due to the high-speed rotation. Thus, if this method is used, there is a limit in decreasing a size of gas that is to be dissolved in a liquid material. Also, if this method is used, when the rotation of the liquid material is stopped, the size of gas dissolved in the liquid material cannot be decreased into a fine size, and thus, the gas dissolved in the water easily float and escape as time goes.

A water exposure method is a method in which water is sprayed to an upper space of an oxygen tank so that the water conies in contact with oxygen, and the water is repeatedly sprayed until the oxygen concentration reaches a desired level. However, this method does not allow easy production of the water with a high oxygen concentration in aspect of commercial utilization, and its productivity is too low to ensure applicability.

Meanwhile, a dissolved air floating method is a method in which air is firstly dissolved in the water under a high pressure to make supersaturated, air-dissolved water, and the air-dissolved water is re-injected into a water to be subjected to water treatment, such as sewage. In this method, fine air bubbles are generated from the air-dissolved water, and then the air bubbles are combined with the floc dissolved in the water to be subjected to water treatment, so that this method is used for purifying the water to be subjected to water treatment. However, since the dissolved air floating method uses the property of bubbles dissolved in water that tend to move upward, the bubbles should be formed to have a large size, that is the bubbles cannot be formed to be smaller than 50 μm.

There is also introduced a membrane method. In this method, a fine porous material is formed of ceramic or metal, and oxygen bubbles are formed through a porous membrane of a filter that is made of the fine porous material. However, this method has a technical limit since it is impossible until now to make a nano-sized fine porous membrane of ceramic or metal.

Prior art documents studied by the inventor until now are as follows:

Patent Documents

Korean Patent Registration No. 155482, entitled "Apparatus for Purification of River, Lake or Pond".

Japanese Laid-open Patent Publication No. H08-255094, entitled "Micro Bubble Generating Apparatus".

Korean Patent Registration No. 845785, entitled "Apparatus and Method for Generating Micro Bubbles".

Korean Patent Registration No. 844141, entitled "Silica or Alumina Ceramic Diffuser for Generating Microbubbles, Method for Manufacturing the Same and Method for Air-Floatation Using the Same".

Non-patent Documents

Masayoshi Takahashi et al., "Free-Radical Generation from Collapsing Microbubbles in the Absence of a Dynamic Stimulus", J. Phys. Chem. B2007, Vol. 111, pp. 1343-1347, 2007.

Masayoshi Takahashi, Taro Kawamura, Yoshitaka Yamamoto, Hirofumi Ohnari, Shouzou Himuro, and Hideaki Shakutsui, "Effect of Shrinking Microbubble on Gas Hydrate Formation", The J. of Physical Chemistry, VOL. 107, No. 10, pp. 2171-73, 2003.

Shu Liva, Qunhui Wang, Hongzhi Ma, Peikun Huanga, Jun Li, Takashige Kikuchi, "Effect of micro-bubbles on coagulation flotation process of dyeing wastewater", Separation and Purification Technology, Vol. 71, pp. 337-346, 2010.

Fernanda Yumi Ushikuboa, Takuro Furukawa, Ryou Nakagawa, Masatoshi Enaria, Yoshio Makino, Yoshinori Kawagoe, Takeo Shiina, Seiichi Oshitaa, "Evidence of the Existence and the Stability of Nano-bubbles in Water", Colloids and Surfaces A: Physicochem. Eng. Aspects, Accepted date: Apr. 3, 2010.

Amit Katiyar, Kausik Sarkar, "Stability analysis of an encapsulated microbubble against gas diffusion", Journal of Colloid and Interface Science, Vol. 343, pp. 42-47, 2010.

SUMMARY OF THE INVENTION

As described above, a conventional method for generating and dissolving gas has a disadvantage in that a large amount lot of energy is consumed, a fine structure of the water is broken due to a rotational force applied from the outside, and the gas dissolved in the water is allowed to easily escape to the outside.

Therefore, an object of the present invention is to provide a method for allowing bubbles to remain in a liquid for a long time by generating bubbles having a nano-size diameter in the liquid without consuming a large amount of energy and without using any external mechanical force.

Another object of the present invention is to provide an apparatus for generating nano-bubble, which is suitable for a method for allowing bubbles to remain in a liquid for a long time by generating bubbles having a nano-size diameter in the liquid without consuming a large amount of energy.

A method for generating nano-bubbles in a liquid according to the present invention preferably utilizes a nano-bubble generating apparatus in which a bamboo filter member is used as an essential component. The nano-bubble generating apparatus preferably includes a fixing member for supporting and fixing the bamboo filter member in a certain shape, and a gas supply member for inputting an external gas into the bamboo filter member through the fixing member.

In a method for generating nano-bubbles in a liquid according to the present invention, in a state that a bamboo filter member made by removing an enamel layer partially or entirely is submerged in a liquid, a gas is applied to an inside of the bamboo filter member with a pressure over atmospheric pressure, and the gas is allowed to permeate from an inner wall of the bamboo filter member to an outer wall thereof, thereby generating nano-bubbles in the liquid. At this time, the nano-bubbles are partially ruptured and dissolved in the liquid or remain as nano-bubbles in the liquid.

According to the present invention, as for the bamboo filter member, a bamboo having grown for 1 to 4 years is selected, an enamel layer in a skin thereof is removed, and then a bamboo fibrous layer therein is used as an essential component of the filter member.

According to the present invention, the bamboo filter member may be obtained by cutting a bamboo at portions between its joints or by forming a hole in a bamboo joint so that a gas may pass through it.

According to the present invention, the bamboo filter member may be used in a cylindrical shape, a semi-cylindrical shape by splitting the cylindrical shape, or a plate shape by further splitting or thermally deforming the cylindrical shape.

According to the present invention, the nano-bubble generating apparatus includes a bamboo filter member made of a bamboo material, a fixing member for maintaining the bamboo filter member in a certain shape and supporting and fixing the shape, and a gas supply member for injecting or supplying a gas into the bamboo filter member.

According to the present invention, when the bamboo filter of a cylindrical shape is used, it is preferable to close front and rear portions of the cylindrical shape and form a gas supply hole at the front portion (see FIGS. 2 and 3). When the bamboo filter of a semi-cylindrical or plate shape is used, it is preferable to close an opposite side of the bamboo filter and its front and rear portions and form a gas supply hole at the front or rear portion (see FIGS. 4 and 5).

In addition, in order to generate a large amount of bubbles within a short time, several tens of cylindrical, semi-cylindrical or plate-shaped unit nano-bubble generating apparatuses may be united into a package form. In this way, it is possible to increase a bubble generating area and shorten a maintenance time.

According to the present invention, the gas may be suitably selected depending on the usage of a nano-bubble liquid obtained by the present invention, and not limited to a specific gas. More preferably, the gas may be any one selected from the group consisting of air, oxygen, nitrogen, hydrogen, and carbonic acid gas.

As described above, the method for generating nano-bubbles in a liquid according to the present invention uses a naturally grown bamboo as a filter member. Thus, a gas may be easily generated and dissolved in a liquid at a much lower cost, in comparison with a method using ceramic material or other artificial material as the filter member.

In addition, the method for generating nano-bubbles in a liquid according to the present invention never applies an external force, caused by artificial rotation, to water so that a basic fine structure of the water is not destructed and the fine structure of the water most similar to a natural state can be maintained as it is.

Further, the method for generating nano-bubbles in a liquid according to the present invention allows nano gas components to be dissolved in the water over a saturation concentration, so that the gas components may remain and be dissolved in the water for a long time.

DESCRIPTION OF THE PREFERRED EMBODIMENT

Hereinafter, preferred embodiments of the present invention will be described in detail with reference to the accompanying drawings. However, it is obvious that the accompanying drawings are only for more detailed explanation of the present invention, and the spirit of the present invention is not limited thereto.

Figure 1:
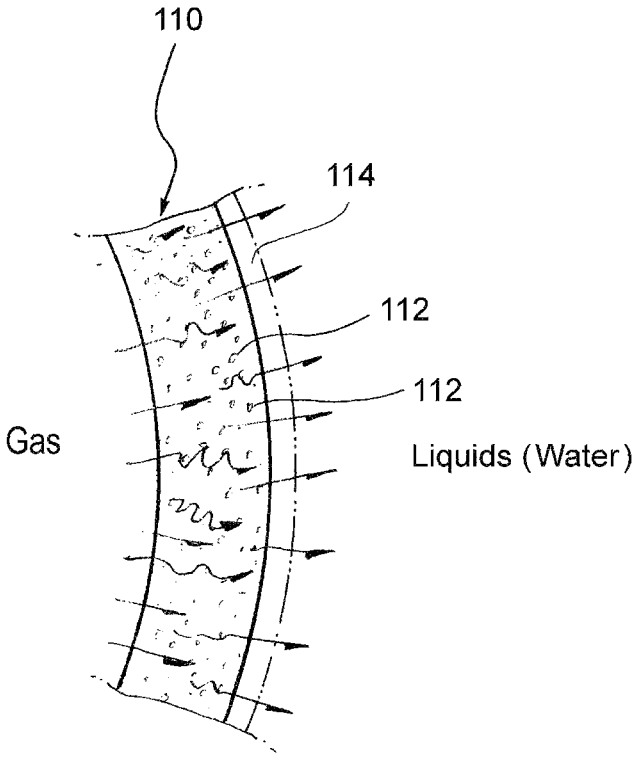
FIG. 1 is a schematic view illustrating a method for dissolving nano-bubbles in water according to the present invention.

FIG. 1 is a schematic view illustrating a method for generating nano-bubbles in water according to the present invention.

A method for generating nano-bubbles in a liquid according to the present invention is implemented in a state that a bamboo filter member 110 made of a bamboo fibrous layer obtained by partially removing an enamel layer is submerged in water.

The bamboo for a filter used in the present invention is selected from bamboos that have grown over 1 year in a natural circumstance. In a case where a bamboo does not grow over 1 year in a natural circumstance, a bamboo fibrous layer 112 is not sufficiently mature, so that gases hardly permeate this bamboo. The bamboos generally have various densities of tissue of the bamboo fibrous layer 112 depending on the number of years during which they have grown. Also, when a bamboo is cut in a direction perpendicular to a longitudinal direction thereof, the bamboo tends to be denser as it goes from a central portion of cylinder to an outside portion, and an outermost layer is a thin and firm enamel layer 114. The bamboo contains water although a small amount, so that it is preferable to dry the bamboo before using it. If the bamboo is dried, moisture escapes from the bamboo fibrous layer 112 so that it is shrunken to make its tissue denser. If the bamboo is excessively dried, the bamboo fibrous layer may be cracked and the bamboo itself may split. Thus, the drying work requires care.

According to the present invention, the enamel layer 114 constituting a skin of the bamboo is preferably removed partially or entirely. It is because the enamel layer 114 greatly disturbs permeation of bubbles. The enamel layer 114 may be removed using a tool such as a blade or a grinder. The method of removing the enamel layer 114 is not specifically limited.

The present invention has a technical feature in that the bamboo fibrous layer 112 present in the bamboo is used as a filter material through which gas permeates. The bamboo fibrous layer 112 has a plurality of xylem vessels therein. It is considered that the bamboo sucks in water at its root, uses the plurality of xylem vessels formed in the bamboo fibrous layer 112 as passages through which water moves upward, and finally supplies the water to leaves. At this time, the xylem vessels are formed in parallel in a longitudinal direction of the bamboo in plural and present in the bamboo fibrous layer 112. However, in the present invention, gases do not permeate through the xylem vessels, but the gases rather permeate fine gaps in the bamboo fibrous layer 112. The arrows shown in FIG. 1 represent how the gases permeate through the fine gaps of the bamboo fibrous layer 112.

In the method for generating nano-bubbles in a liquid according to the present invention, a predetermined gas to be dissolved is applied to an inside of the bamboo fibrous layer 112 over atmospheric pressure, and the gas permeates the bamboo fibrous layer 112 outwards from an inner side thereof to thereby form fine bubbles. The liquid is a liquid material, preferably water, aqueous solution, emulsion, beverage, alcohol, distilled liquor, and oil. Water is most preferred among others. The present invention will be described with the assumption that water is a representative example of liquids for convenience of explanation.

In the present invention, the bamboo fibrous layer 112 is less dense as it goes to a central portion of the bamboo filter but denser as it goes to an outer portion thereof. Thus, it is more preferable that gas permeates the bamboo fibrous layer 112 from the inner central portion to the outer portion. It is because the size of bubble is directly created or formed from a size of the material through which the bubble finally passes. Thus, in a case where it is intended to form bubbles of a greater size with the same bamboo filter, it is preferred that the gas permeates the bamboo fibrous layer 112 inwards from the outer side thereof.

In the present invention, the gas is to be dissolved in water, and the gas may be any one selected from the group consisting of air, oxygen, nitrogen, hydrogen, and carbonic acid gas. The gas may be changed in accordance with a final product. In a common case, oxygen or hydrogen may be used. When it is required to dissolve oxygen in water, an oxygen gas is preferably used. The oxygen dissolved in water is essential for all living things such as plants and animals. An atmospheric air may be used instead of pure oxygen.

If oxygen is deficiently dissolved in water, fish may be suffocated or die, and roots or the like of the crops may rot. It is known that the dissolved oxygen is decreased due to organic matter oxidization and inorganic matter oxidization caused by water microorganisms, breathing of aquatic animals and plants, and the like. If oxygen is deficient in water, not only fish dies, but also various water pollutions occur. In other words, the bottom of a river or lake becomes dark, and decomposition gases and bad smells are generated. It is known that general aquatic organisms need dissolved oxygen of 6 ppm or above, and dissolved oxygen in a river is preferably 7.5 ppm or above. In addition, in case of an agricultural water, roots of crops may rot if dissolved oxygen is 5 ppm or less. A concentration of dissolved oxygen suitable for the growth of fish is about 5 ppm or above although it depends on the kind of fish. Also, it is known that as the concentration of dissolved oxygen is higher, the fish in a cage culture farm having a lot of fishes densely grows fast and has good fish flesh quality close to a naturally occurring fish.

In order to increase the concentration of dissolved oxygen in water, a surface area of oxygen bubbles should be increased to increase the chance of gas/liquid contact. To this end, it is important to generate a large number of bubbles per a unit oxygen volume within a short time. Also, the bubbles should be made to have as small as possible, thereby increasing their solubility. In this case, as the size of bubbles is smaller, a floating speed is also slower to thereby extend a staying time in the water, so that the solubility is increased. Thus, as the size of bubbles is smaller, the concentration of dissolved oxygen may be improved.

In the present invention, the bamboo filter is preferably obtained by cutting the bamboo at portions between its joints. A bamboo is generally grown to have several or several ten joints, and each joint is closed by a membrane. At this time, it is preferred to use the bamboo filter by cutting a bamboo excluding its joint. However, if necessary, it is also possible to use the bamboo filter by boring a hole through the membrane with the bamboo cut including its joints The present invention provides a nano-bubble generating apparatus 100, which has a shape suitable for generating nano-bubbles in a liquid.

Figure 2:
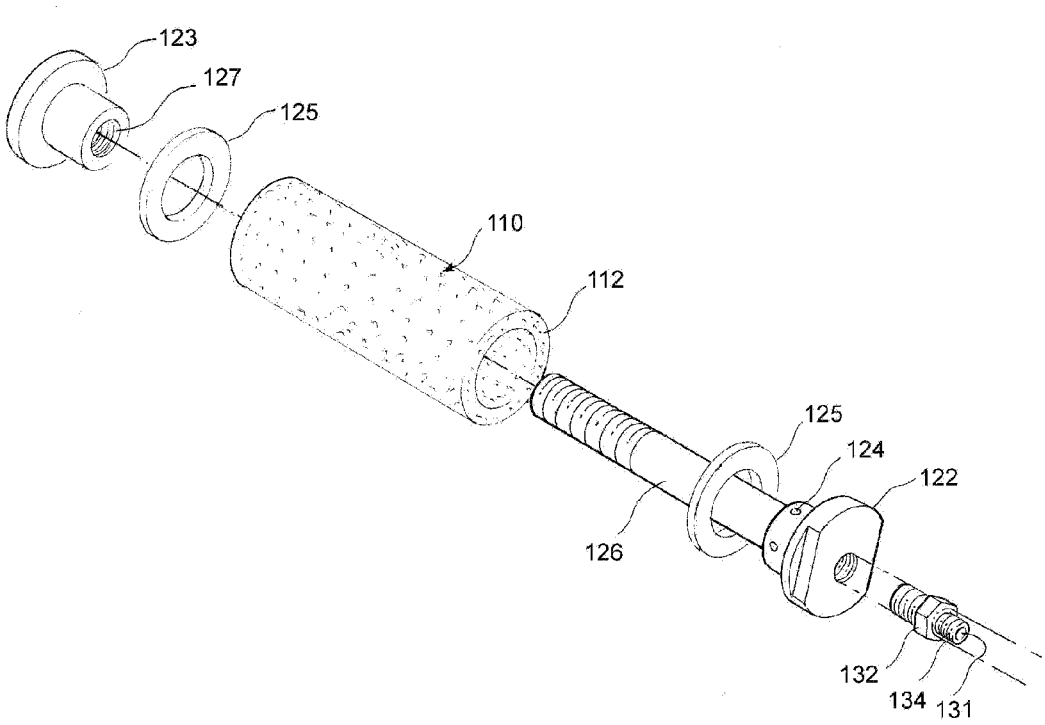
FIG. 2 is an exploded perspective view schematically showing that a cylindrical bamboo filter member is used in a preferred embodiment of a nano-bubble generating apparatus 100 according to the present invention.
Figure 3:
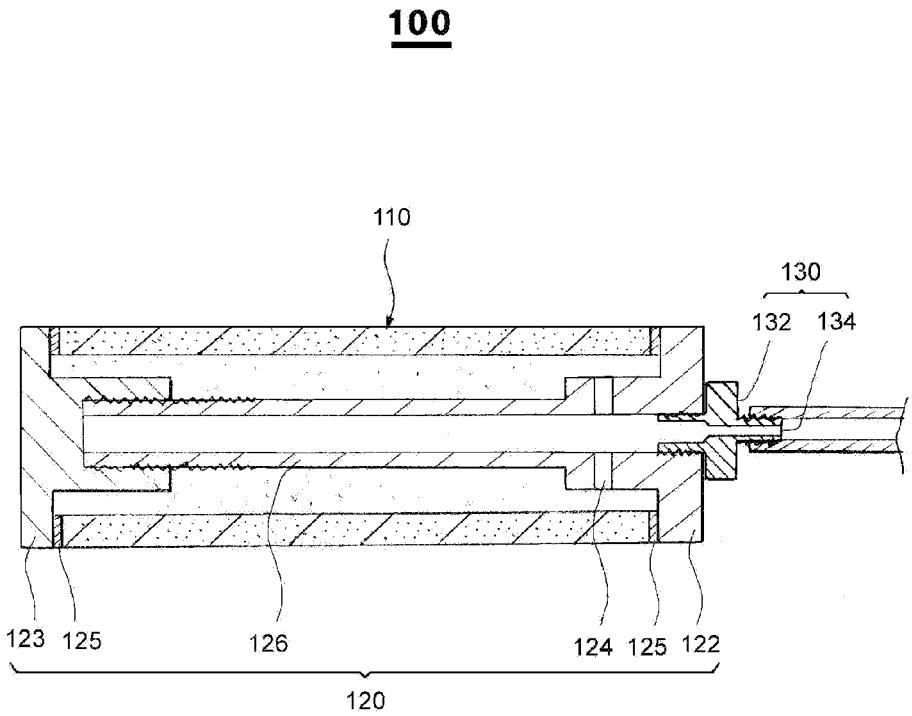
FIG. 3 is a schematic sectional view showing the nano-bubble generating apparatus of FIG. 2.

FIG. 2 is an exploded perspective view schematically showing that a cylindrical bamboo filter member is used in a preferred embodiment of a nano-bubble generating apparatus 100 according to the present invention;

FIG. 3 is a schematic sectional view showing the nano-bubble generating apparatus of FIG. 2.

Figure 4:
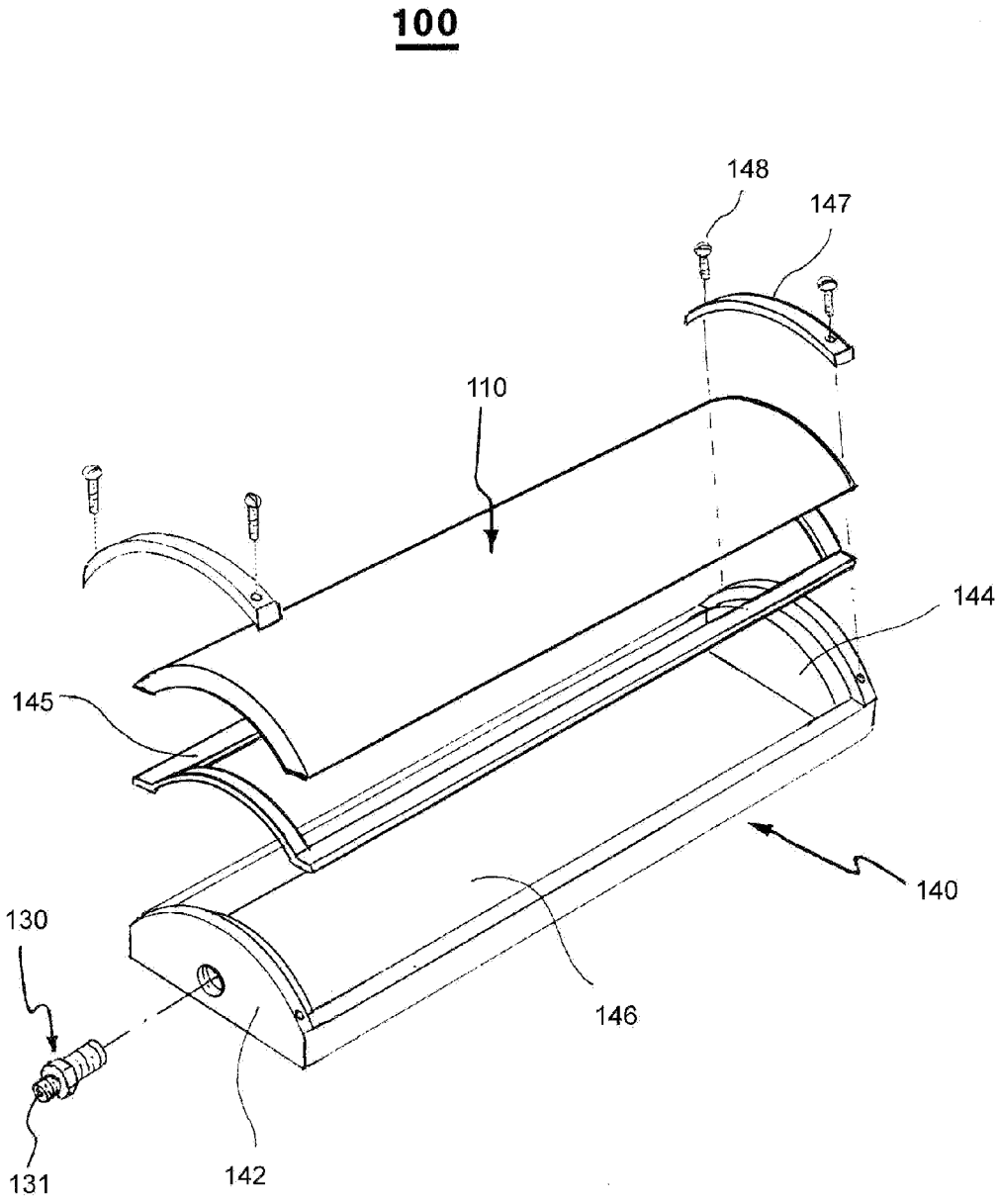
FIG. 4 is an exploded perspective view schematically showing that a semi-cylindrical bamboo filter member is used in another preferred embodiment of a nano-bubble generating apparatus 100 according to the present invention.
Figure 5:
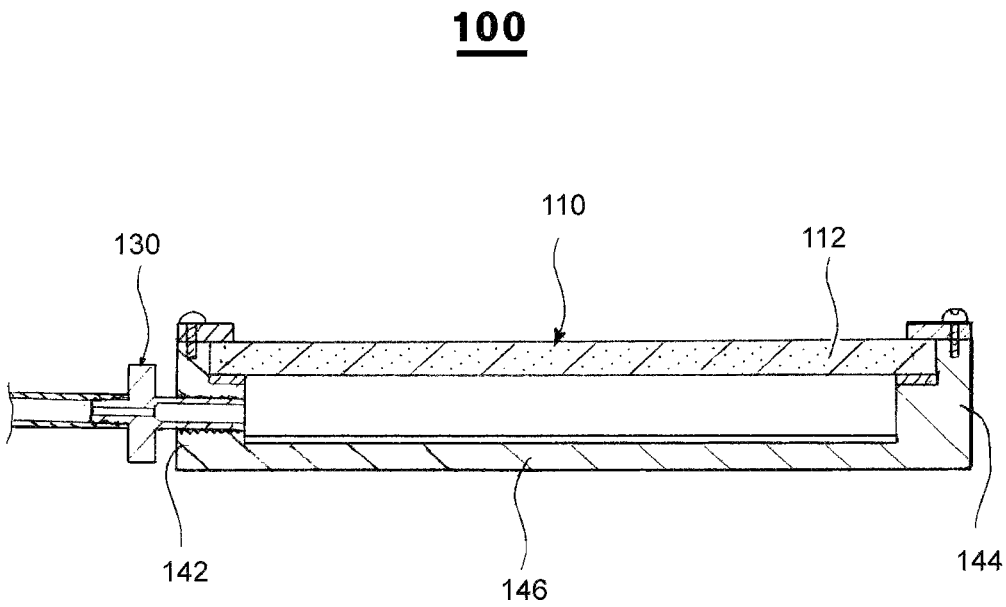
FIG. 5 is a schematic sectional view showing that a plate-shaped bamboo filter member is used in a further preferred embodiment of a nano-bubble generating apparatus 100.

FIG. 4 is an exploded perspective view schematically showing that a semi-cylindrical bamboo filter member is used in another preferred embodiment of a nano-bubble generating apparatus 100 according to the present invention; and FIG. 5 is a schematic sectional view showing that a plate-shaped bamboo filter member is used in a further preferred embodiment of a nano-bubble generating apparatus 100.

A nano-bubble generating apparatus 100 according to the present invention includes a bamboo filter member 110 made of a bamboo material, a fixing member 120 for maintaining the bamboo filter member in a certain shape and supporting the bamboo filter member to preserve its shape, and a gas supply member 130 for injecting or supplying a gas into the bamboo filter member 110.

The nano-bubble generating apparatus 100 according to the present invention includes the bamboo filter member 110 made of a bamboo material. The bamboo filter member 110 is preferably made by selecting a bamboo having grown for 1 to 4 years, drying the bamboo, removing an enamel layer 114 in a skin thereof, and then using a bamboo fibrous layer 112 therein as an essential component.

According to the present invention, the bamboo filter member 110 may be classified into a cylindrical product obtained by cutting a bamboo by a certain length in a longitudinal direction of the bamboo, a semi-cylindrical product obtained by splitting the cylindrical bamboo into two or four parts, and a plate-shaped product obtained by dividing the cylindrical bamboo into several parts and then straightening the divided part to be flat. The bamboo filter member 110 is already described above in detail, so that its detailed descriptions will be omitted.

The nano-bubble generating apparatus 100 according to the present invention includes the fixing member 120 or 140 for maintaining the bamboo filter member 110 in a certain shape and supporting the bamboo filter member 110 to preserve its shape.

In the present invention, the fixing member 120 or 140 may be configured with a fastening means such as a band surrounding the bamboo filter member 110 or a fixing means such as a clip located in and/or out of the bamboo filter member 110. It prevents the bamboo filter member 110 from being ruptured or broken though it is used at a normal or high pressure in a liquid.

According to the present invention, in a case where the bamboo filter member 110 has a cylindrical shape, the fixing member 120 includes a front cap 122 coupled to a front portion of the bamboo filter member 110 to close the front portion, and a rear cap 123 coupled to a rear portion thereof (see FIGS. 2 and 3). The front cap 122 and the rear cap 123 may firmly seal the bamboo filter member 110 by using packings 125. The front cap 122 preferably has gas vent holes 124 through which the gas supplied from the gas supply member 130 may flow out toward the bamboo filter member 110. The front cap 122 and the rear cap 123 are preferably coupled with each other through a connection rod 126 provided therebetween. To this end, a male thread portion formed at the other end of the connection rod 126 may be coupled with a female thread portion 127 formed in the rear cap 123. In this case, there is no need to prepare another coupling means separately, so that an external appearance of the product may be formed aesthetic.

In the present invention, in a case where the bamboo filter member 110 is formed in a semi-cylindrical or plate shape, the fixing member 140 is preferably made in a integrated form to maintain and support the shape of the bamboo filter member 110 (see FIGS. 4 and 5). The integrated fixing member 140 preferably includes a front sealing portion 142 coupled to one side of the bamboo filter member 110, a rear sealing portion 144 coupled to the other side of the bamboo filter member 110, and a bottom sealing portion 146 for connecting the front sealing portion 142 and the rear sealing portion 144 with each other, the bottom sealing portion 146 being present at an opposite side to the bamboo filter member 110. The front sealing portion 142, the rear sealing portion 144 and the bottom sealing portion 146 may firmly seal the semi-cylindrical bamboo filter member 110 by inserting a packing 145 therebetween. The front sealing portion 142 and the rear sealing portion 144 are integrally formed by means of the bottom sealing portion 146. However, the present invention is not limited to such a shape, and in a state where the front and rear sealing portions are separated from each other, both sealing caps may be coupled to the bottom sealing portion 146. Coupling pieces 147 and coupling screws 148 may be used to firmly fix the bamboo filter member 110 to the front sealing portion 142 and the rear sealing portion 144.

The nano-bubble generating apparatus 100 according to the present invention includes the gas supply member 130 for injecting or supplying a gas into the bamboo filter member 110.

According to the present invention, the gas supply member 130, which is to input the gas supplied from the outside into the bamboo filter member 110, is connected to the bamboo filter member 110 through the fixing member 120. The gas supply member 130 may be coupled to the front cap 122 or the rear cap 123, or to the front sealing portion 142 or the rear sealing portion 144. The gas supply member 130 includes an inner gas passage 131 that allows an external gas to flow therethrough, a body portion 132 for protecting the inner gas passage 131 and defining an external appearance thereof, and a coupling unit 134 capable of being coupled to an external air supply hose. The body portion 132 may be made to have a hexagonal nut shape so that it may be more easily coupled to the fixing member 120 or the integrated fixing member 140.

Example 1

A bamboo having grown for 2 years was collected and dried in a cool shade, then the bamboo was cut at portions between its joints, and its skin was partially removed with a grinder. Thereafter, a cylindrical bamboo filter member 110 having a cylindrical bamboo fibrous layer 112 having a diameter about 6 cm and a length of about 21 cm was made. The cylindrical bamboo filter member 110 was placed at the center so that a front cap 122 was coupled to one end of the bamboo filter member and a rear cap 123 was coupled to the opposite end thereof. Packings 125 were respectively fit around and coupled to the front cap 122 and the rear cap 123, so that the bamboo filter member 110 was firmly sealed between the front and rear caps. Also, the front cap 122 and the rear cap 123 were connected with each other through a connection rod 126, and the front cap 122 was coupled with a gas supply member 130 at a side opposite to the connection rod 126. In this way, a cylindrical nano-bubble generating apparatus 100 according to the present invention was completed.

Example 2

A bamboo having grown for 2 years was collected and dried in a cool shade, then the bamboo was cut at portions between its joints, and then its skin was partially removed with a grinder. Thereafter, a bamboo material for filter having a cylindrical bamboo fibrous layer 112 having a diameter about 6 cm and a length of about 21 cm was made. After the bamboo material for filter was obtained, it was split in half along its center to make two semi-cylindrical bamboo filter members 110.

An integrated fixing member 140, which is separately prepared, was placed on the floor, and the semi-cylindrical bamboo filter member 110 was then put thereon so that the cylindrical bamboo filter member 110 was interposed between the front sealing portion 142 and the rear sealing portion 144. At this time, a packing 145 was inserted between the integrated fixing member 140 and the semi-cylindrical bamboo filter member 110 for complete sealing. Coupling pieces 147 and coupling screws 148 were respectively applied at both ends of the semi-cylindrical bamboo filter member 110 so that the semi-cylindrical bamboo filter member 110 was firmly coupled to the integrated fixing member 140. Meanwhile, the gas supply member 130 was coupled to the front sealing portion 142. In this way, a semi-cylindrical nano-bubble generating apparatus 100 according to the present invention was completed.

Example 3

A transparent octagonal bucket having a height of 1.1 meter and a diameter of 55 cm was filled with about 200 liter of water. Meanwhile, two of the cylindrical nano-bubble generating apparatuses 100 according to Example 1 were prepared. For each apparatus, an air injection hose was coupled to the coupling unit 134 of the gas supply member 130, and the air injection hose was connected to an external high-pressure oxygen tank.

The two cylindrical nano-bubble generating apparatuses 100 were input into the octagonal buckets, and supplied with oxygen gas for about 2 hours by turning on an external high-pressure oxygen tank. The oxygen gas supplied from the high-pressure oxygen tank was input into the cylindrical nano-bubble generating apparatus 100 through the air injection hose and the inner gas passage 131 of the gas supply member 130. The cylindrical nano-bubble generating apparatuses 100 were supplied with oxygen gas of a pressure of 4.0 bar by controlling the external high-pressure oxygen tank. Here, the water had a temperature of 18° C.

In order to check properties of oxygen water prepared according to the present invention, for the water prepared according to Example 3, the size and number of newly generated oxygen bubbles were measured. The measurement was performed as follows.

The water obtained in Example 3 was left alone for about 48 hours, and then the size and number of nano oxygen bubbles present in the water were measured. The measuring equipment was Model LM10-HS produced by NanoSight Ltd., UK. As a result of the measurement, it was confirmed that an average diameter of nano-bubbles were 128 nm, SD was 82 nm, $D_{10}$ was 34 nm, $D_{50}$ was 116 nm, $D_{90}$ was 246 nm, and the number of nano-bubbles was $2.35\times10^8$. Such experimental results were not predicted within the knowledge of the inventor.

Example 4

The same bucket as in Example 3 was filled with water of the same amount as in Example 3. Meanwhile, four of the semi-cylindrical nano-bubble generating apparatuses 100 according to Example 2 were prepared. Four air injection hoses were respectively coupled to the coupling units 134 of the gas supply members 130, and then the four air injection hoses were connected to an external high-pressure oxygen tank.

The four semi-cylindrical nano-bubble generating apparatuses 100 were input into the octagonal bucket, and supplied with oxygen gas for about 2 hours by turning on the external high-pressure oxygen tank. The oxygen gas supplied from the high-pressure oxygen tank was input into the four semi-cylindrical nano-bubble generating apparatuses 100 through the air injection hoses and the inner gas passages 131 of the gas supply members 130, respectively. The semi-cylindrical nano-bubble generating apparatuses 100 were supplied with the oxygen gas of a pressure of 4.0 bar by controlling the external high-pressure oxygen tank. Here, the water had a temperature of 18° C.

In order to check properties of oxygen water prepared according to the present invention, for the water prepared according to Example 4, the size and number of newly generated oxygen bubbles were measured. The measurement was performed as follows.

The water obtained in Example 4 was left alone for about 48 hours, and then the size and number of nano oxygen bubbles present in the water were measured. The measuring equipment was Model LM10-HS produced by NanoSight Ltd., UK. As a result of the measurement, it was confirmed that an average diameter of nano-bubbles were 106 nm, SD was 46 nm, $D_{10}$ was 49 nm, $D_{50}$ was 102 nm, $D_{90}$ was 165 nm, and the number of nano-bubbles was $1.41\times10^8$. The experiment results were not predicted within the knowledge of the inventor.

Comparing the experiment results of Example 3 with those of Example 4, it was found that both the cylindrical nano-bubble generating apparatus and the semi-cylindrical nano-bubble generating apparatus generate nano-sized fine bubbles of oxygen gas in the water, and are equal in performance. However, since Example 3 uses the two cylindrical nano-bubble generating apparatuses and Example 4 uses the four semi-cylindrical nano-bubble generating apparatuses, it would be more preferable to use the cylindrical nano-bubble generating apparatus in respect of a production cost.

Example 5

Example 5 was performed under the same conditions as Example 3, except that the high-pressure oxygen tank is substituted with a high-pressure hydrogen tank.

In order to check properties of hydrogen water prepared according to the present invention, the size and number of fine hydrogen bubbles left in water were measured. The measurement was performed using Model LM10-HS produced by NanoSight Ltd., UK, under the same conditions as Example 3. As a result of the measurement, an average diameter of nano hydrogen bubbles were 250 nm, SD was 148 nm, $D_{10}$ was 79 nm, $D_{50}$ was 215 nm, $D_{90}$ was 478 nm, and the number of nano-bubbles was $2.05\times10^8$.

Comparing the experiment results of Example 5 with those of Example 3, it was confirmed that the size of nano-bubbles in the hydrogen water prepared in Example 5 is slightly greater than that of nano-bubbles in the oxygen water prepared in Example 3. However, it was also confirmed that the size of hydrogen bubbles in the hydrogen water prepared in Example 5 was also a nano size.

Example 6

Example 6 was performed under the same conditions as Example 3, except that the high-pressure oxygen tank is substituted with a high-pressure air tank.

In order to check properties of air-dissolved water prepared according to the present invention, the size and number of fine air bubbles left in water were measured. The measurement was performed using Model LM10-HS produced by Nano-Sight Ltd., UK, under the same conditions as Example 3. As a result of the measurement, an average diameter of nano hydrogen bubbles were 250 nm, SD was 148 nm, $D_{10}$, was 79 nm, $D_{50}$ was 215 nm, $D_{90}$ was 478 nm, and the number of nano-bubbles was $2.05\times10^8$.

Comparing the experiment results of Example 6 with those of Example 3, it was confirmed that the size of air nano-bubbles prepared in Example 6 is slightly greater than that of nano-bubbles in the oxygen water prepared in Example 3. However, such results could be predicted since the size of bubbles depends on the bamboo itself or the degree of removal of the enamel layer of the bamboo. Meanwhile, it was also confirmed that the size of air bubbles in the air-dissolved water prepared in Example 6 was also a nano size.

Considering the measurement results of Examples 3 to 6, it could be confirmed that the method for generating nano-bubbles in a liquid according to the present invention may be identically applied to any of oxygen, hydrogen and air.

Example 7

Example 7 was performed under the same conditions as Example 3, except that the transparent octagonal bucket was filled with about 200 liters of water containing 1% of pycnogenol instead of pure water.

In order to check an oxygen bubble dissolution property of the pycnogenol-containing oxygen water prepared according to the present invention, for the water prepared according to Example 7, the size and number of newly generated oxygen bubbles were measured. The measurement method and equipment were identical to those of Example 3. As a result of the measurement, an average diameter of nano-bubbles were 76 nm, SD was 49 nm, $D_{10}$ was 30 nm, $D_{50}$ was 62 nm, $D_{90}$ was 141 nm, and the number of nano-bubbles was $17.13\times10^8$.

Comparing the experiment results of Example 7 with those of Example 3, it was found that the size of nano oxygen bubbles was further decreased and the number of nano-bubbles is further increased when a small amount of additive was added to the water, in comparison with a case where pure water is used.

Example 8

Example 8 was performed under the same conditions as Example 5, except that the transparent octagonal bucket was filled with about 200 liters of water containing 1% of pycnogenol instead of pure water.

In order to check properties of the pycnogenol-containing hydrogen water prepared according to the present invention, for the water prepared in Example 8, the size and number of newly generated hydrogen bubbles were measured. The measurement method and equipment were identical to those of Example 7. As a result of the measurement, an average diameter of nano-bubbles were 145 nm, $D_{10}$ was 36 nm, $D_{50}$ was 90 nm, $D_{90}$ was 180 nm, and the number of nano-bubbles was $7.17\times10^8$.

Comparing the experiment results of Example 8 with those of Example 5, it was found that the size of nano hydrogen bubbles was further decreased and the number of nano-bubbles is further increased when a small amount of additive was added to the water, in comparison with a case where pure water is used.

Example 9

Example 9 was performed under the same conditions as Example 3, except that a 500 ml beaker was filled with 360 ml of a distilled liquor commercially available from Jinro Co. Ltd. under the trade designation "Chamisul" instead of filling the transparent octagonal bucket with a pure water, and a cylindrical filter member having a diameter of 3 cm and a length of about 6.5 cm was used in the beaker.

In order to check properties of the oxygen distilled liquor prepared according to the present invention, for the distilled liquor prepared in Example 9, the size and number of newly generated oxygen bubbles were measured. The measurement method and equipment were identical to those of Example 3. As a result of the measurement, an average diameter of nano oxygen bubbles were 99 nm, SD was 55 nm, $D_{10}$ was 36 nm, $D_{50}$ was 87 nm, $D_{90}$ was 171 nm, and the number of nano-bubbles was $2.02\times10^8$.

Example 10

Example 10 was performed under the same conditions as Example 9, except that hydrogen was used instead of oxygen.

In order to check properties of the hydrogen distilled liquor prepared according to the present invention, for the distilled liquor prepared in Example 10, the size and number of newly generated hydrogen bubbles were measured. The measurement method and equipment were identical to those of Example 9. As a result of the measurement, an average diameter of nano hydrogen bubbles were 68 nm, SD was 25 nm, $D_{10}$ was 38 nm, $D_{50}$ was 66 nm, $D_{90}$ was 101 nm, and the number of nano-bubbles was $2.16\times10^8$.

Comparing the experiment results of Examples 9 and 10, it was found that the method for generating nano-bubbles in a liquid according to the present invention allows nano-bubbles to be formed even in a distilled liquor. It means that the method for generating nano-bubbles in a liquid according to the present invention can be identically applied to a beverage that is widely used.

Example 11

The green algae removing performance was experimentally determined in order to check whether the method for generating nano-bubbles in a liquid according to the present invention can be applied to actual aquatic plants in the open air.

The experiment was performed in Bulgap reservoir at Noksan-ri, Bulgap-myeon, Younggwang-gun, Jeollanam-do, Republic of Korea. Bulgap reservoir has a depth of about 4 meters, and an atmospheric temperature of about 30° C. Green algae were observed to be very dense in a layer having a thickness of about 5 mm from the water surface. The cylindrical nano-bubble generating apparatus according to Example 1 was hang down and installed at a bottom of the reservoir, and it was connected to an external oxygen tank. The oxygen tank supplied oxygen gas at a pressure of about 5 bar.

As a result of observation by naked eyes, after the experiment was initiated, the green color gradually faded outwards from the center of the cylindrical nano-bubble generating apparatus, and the color-fading area was expanded as time goes. After about 2 hours, no green alga was observed by naked eyes from the center of the nano-bubble generating spot.

Example 12

In order to fine a more effective and economical method for removing green algae in an outdoor reservoir, an experiment using an air was performed.

Example 12 was performed under the same conditions as in Example 11, except that a high-pressure air tank was used instead of the high-pressure oxygen tank.

As a result of observation by naked eyes, after the experiment was initiated, the green color gradually faded outwards from the center of the cylindrical nano-bubble generating apparatus 100, and the color-fading area was expanded as time goes. After about 2 hours, no green alga was observed by naked eyes from the center of the nano-bubble generating spot.

Comparing Example 11 with Example 12, no serious difference could be found. Thus, it was presumed that the removal of green algae was enabled by instant energy released when nano-bubbles of a gas ruptures, regardless of the kind of gas used.

In FIG. 6, a left photograph shows untreated raw water of Bulgap reservoir, and a right photograph shows treated water after the raw water was treated with high-pressure air for 2 hours.

Examples 11 and 12 demonstrate that the method for generating nano-bubbles in a liquid according to the present invention is one of effective methods to instantly cope with the algal bloom in the open air. The present invention can be applied when the algal bloom occurs which becomes a serious issue in these days, and is also considered to be very useful for the water management in a water source and the management of fisheries of fish farmers.

As described above, it could be confirmed that the methods for generating nano-bubbles in a liquid according to the present invention allowed generation of nano-bubbles not only in water but also in other kinds of liquids. Also, the nano-bubbles can be generated by using not only oxygen but also hydrogen, nitrogen and air, which means that almost all kinds of gases can be utilized.

The methods for generating nano-bubbles in a liquid according to the present invention and the nano-bubble generating apparatuses suitable for the methods have been described above in detail, but they are only most preferred embodiments. The present invention is not limited thereto, but the scope of the invention is determined and defined by the appended claims.

In addition, various changes and modifications can be made by those having ordinary skill in the art from the description of the present invention, and it is obvious that such changes and modifications are also within the scope of the present invention.

What is claimed is:

1. A method for generating nano-bubbles in a liquid, comprising the steps of:

preparing a bamboo filter by partially or entirely removing an enamel layer of a bamboo and using a bamboo fibrous layer therein as a component of a filter;

applying a gas to an inside of the bamboo filter with a pressure over atmospheric pressure in a state where the bamboo filter is submerged in a liquid; and making the gas permeate from an inside of the bamboo fibrous layer to an outside thereof, thereby forming nano-bubbles in the liquid.

2. The method as claimed in claim 1, wherein the liquid is any one selected from the group consisting of water, aqueous solution, emulsion, beverage, alcohol, distilled liquor, and oil.

3. The method as claimed in claim 1, wherein the gas is any one selected from the group consisting of oxygen, hydrogen, air, and nitrogen.

* * * * *